US005513401A

United States Patent [19]

Abe et al.

[11] Patent Number: 5,513,401

[45] Date of Patent: May 7, 1996

[54] WATERMATTRESS APPARATUS

[75] Inventors: Takeo Abe; Shoji Kawamura, both of Tokyo, Japan

[73] Assignee: France Bed Co., Ltd., Tokyo, Japan

[21] Appl. No.: 300,048

[22] Filed: Sep. 2, 1994

[30] Foreign Application Priority Data

| | | | |
|---|---|---|---|
| Sep. 10, 1993 | [JP] | Japan | 5-049330 U |
| Oct. 15, 1993 | [JP] | Japan | 5-055822 U |
| Apr. 8, 1994 | [JP] | Japan | 6-070806 |
| Apr. 26, 1994 | [JP] | Japan | 6-088569 |

[51] Int. Cl.[6] ..... A47C 27/10

[52] U.S. Cl. ..... 5/451; 5/422; 5/470; 5/455

[58] Field of Search ..... 5/450, 451, 452, 5/422, 470, 455, 449

[56] References Cited

U.S. PATENT DOCUMENTS

| | | | |
|---|---|---|---|
| 3,766,579 | 10/1973 | Shields | 5/450 |
| 4,221,013 | 9/1980 | Echevarria | 5/455 X |
| 4,316,423 | 2/1982 | Nordstrom | 5/451 X |
| 4,602,396 | 7/1986 | Fraige | 5/451 |
| 4,737,998 | 4/1988 | Johson, Sr. | 5/422 |
| 4,798,936 | 1/1989 | Johnson, Sr. | 5/422 X |
| 4,912,789 | 4/1990 | Maxwell | 5/451 X |
| 5,367,727 | 11/1994 | Dyer, Jr. | 5/451 |

*Primary Examiner*—Michael F. Trettel
*Attorney, Agent, or Firm*—Frishauf, Holtz, Goodman, Langer & Chick

[57] ABSTRACT

A watermattress apparatus has a cushion body which is elastically compressed when a load has been exerted thereon. A case is laminated on the upper surface of the cushion body. The case has upper and lower surfaces and a receiving portion opening to the upper surface. A water bag formed of a flexible waterproof sheet and containing a liquid therein is received in the receiving portion. An envelope covers the laminated cushion body and case.

15 Claims, 6 Drawing Sheets

WATERMATTRESS APPARATUS

BACKGROUND OF THE INVENTION

1. Field of the Invention

This invention relates to a watermattress apparatus having a water bag which contains a liquid.

2. Description of the Related Art

There are various types of mattress apparatuses, which include a watermattress apparatus. The watermattress apparatus has a water bag which contains a liquid. The liquid flows in accordance with the irregularity of the body of a user lying thereon. Thus, the watermattress apparatus is free from a reactive force, which is created in a mattress with a spring unit when the user lies thereon, and corresponds to the amount of compression of the spring unit. Therefore, a heavy portion of the body, such as the hip, is prevented from being strongly stressed.

The watermattress apparatus constructed as above is very advantageous when used as a bed for e.g. a patient or an old man who must lie thereon for a long time, since the apparatus can prevent a bedsore. In light of this, watermattress apparatuses have been widely used.

The watermattress apparatus generally has a case which includes a receiving portion receiving the above-described water bag. This case is covered with an envelope made of cloth.

The liquid contained in the water bag is incompressible though it deforms the water bag during flowing. Thus, the watermattress apparatus receiving the water bag does not have such comfortable cushion properties as a spring mattress has. In other words, the watermattress does not provide comfortable elastic compression when the weight of the user has been exerted thereon.

Further, the liquid contained in the water bag becomes very cold in winter. To prevent this, a heater is provided in the case receiving the water bag to heat the liquid to a temperature comfortable to the user.

It is said that the temperature which enables the user to have a comfortable sleep is about 33°±1° C., and that the user can have a good sleep when the temperature of the legs of the user is higher by 3° C. than the other portions of the body. If, however, the user is oversensitive to cold, the temperature of the legs is generally lower by 3° C. than the other portions of the body, a comfortable sleep cannot be obtained unless the legs are heated at a higher temperature than the other portions.

The above-described water bag is formed of a flexible and waterproof sheet member which is made of rubber or vinyl. If the water bag is stung by a knife or the like, or receives a great shock, or deteriorates with age, the liquid contained therein may leak from the bag to the receiving portion of the case.

To prevent the liquid from leaking from the case, a waterproof bottom sheet is provided in the receiving portion. This bottom sheet, however, cannot completely prevent penetration of the leaked liquid into the envelope and then to the outside thereof.

In order to prevent the penetration of the leaked liquid into the envelope, it is considered to cover, with an upper sheet, the upper side of the receiving portion, to which the receiving portion opens.

However, where the upper sheet is provided between the case and the envelope, the sweat of the user body lying on the envelope or moisture in the atmosphere can easily gather on the upper sheet. Since the upper sheet is in contact with the water bag and hence has a low temperature, the moisture which contacts the upper sheet condenses into a dew. It is possible that a great amount of dews gathers on the upper sheet and penetrates into the envelope which contacts the upper sheet, with the result that spots appear on the envelope. Moreover, the envelope is liable to have a moisture, which may give the user a bad feeling, may cause propagation of bacteria, or may emit off-flavor.

SUMMARY OF THE INVENTION

It is an object of the invention to provide a watermattress apparatus with cushion properties which enables the user to be elastically supported.

It is another object of the invention to provide a watermattress apparatus capable of warming the legs of the user at a temperature higher than the other portions of the body.

It is a further object of the invention to provide a watermattress apparatus capable of preventing a liquid, leaked from the water bag to the case, from further leaking to the outside of the case.

It is yet another object of the invention to provide a watermattress apparatus which has an envelope wherein moisture can easily escape therefrom even when an upper sheet is provided on the envelope for preventing a liquid having leaked from the water bag, from penetrating into the envelope.

According to a preferred embodiment as claimed in claim 1, there is provided a watermattress apparatus comprising:

a cushion body being elastically compressed when a load has been exerted thereon;

a case having upper and lower surfaces and a receiving portion opening to the upper surface, the lower surface being laminated on the upper surface of the cushion body;

a water bag formed of a flexible waterproof sheet, containing a liquid therein, and received in the receiving portion of the case; and an envelope covering the laminated cushion body and case.

According to another embodiment as claimed in claim 10, there is provided a watermattress apparatus comprising:

a cushion body;

a case having upper and lower surfaces and a receiving portion opening to the upper surface;

a plurality of water bags formed of a flexible waterproof sheet, containing a liquid therein, and received in the receiving portion such that they are arranged parallel to one another in a predetermined direction;

a plurality of heaters provided in the case for heating the liquid contained in the water bags, respectively;

control means for controlling the temperature of the liquid in that one of the water bags which is located at an end in the predetermined direction, to be higher than that in the other water bags; and an envelope covering a laminated structure of the cushion body and the case.

According to an embodiment as claimed in claim 15, there is provided a watermattress apparatus comprising:

a case having upper and lower surfaces and a receiving portion opening to the upper surface;

a water bag formed of a flexible waterproof sheet, containing a liquid therein, and received in the receiving portion;

inner absorbent means provided in the receiving portion for absorbing a liquid which has leaked from the water bag to the receiving portion;

a waterproof sheet covering the upper side of the case for preventing the liquid from leaking from the receiving portion to the outside thereof; and an envelope covering the case.

Since in the watermattress apparatus claimed in claim 1, the case is supported by the cushion body, the user can enjoy comfortable cushion properties.

In the watermattress apparatus claimed in claim 10, liquid contained in that one of the water bags which is located corresponding to the legs of the user can be heated to have a temperature higher than that in the other water bags.

In the watermattress apparatus claimed in claim 15, liquid which has leaked from the water bag to the receiving portion of the case is absorbed in the inner absorbent means provided in the receiving portion, and is hence prevented from leaking to the outside of the case.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

The embodiments of the invention will be explained with reference to the accompanying drawings.

Figure 1:
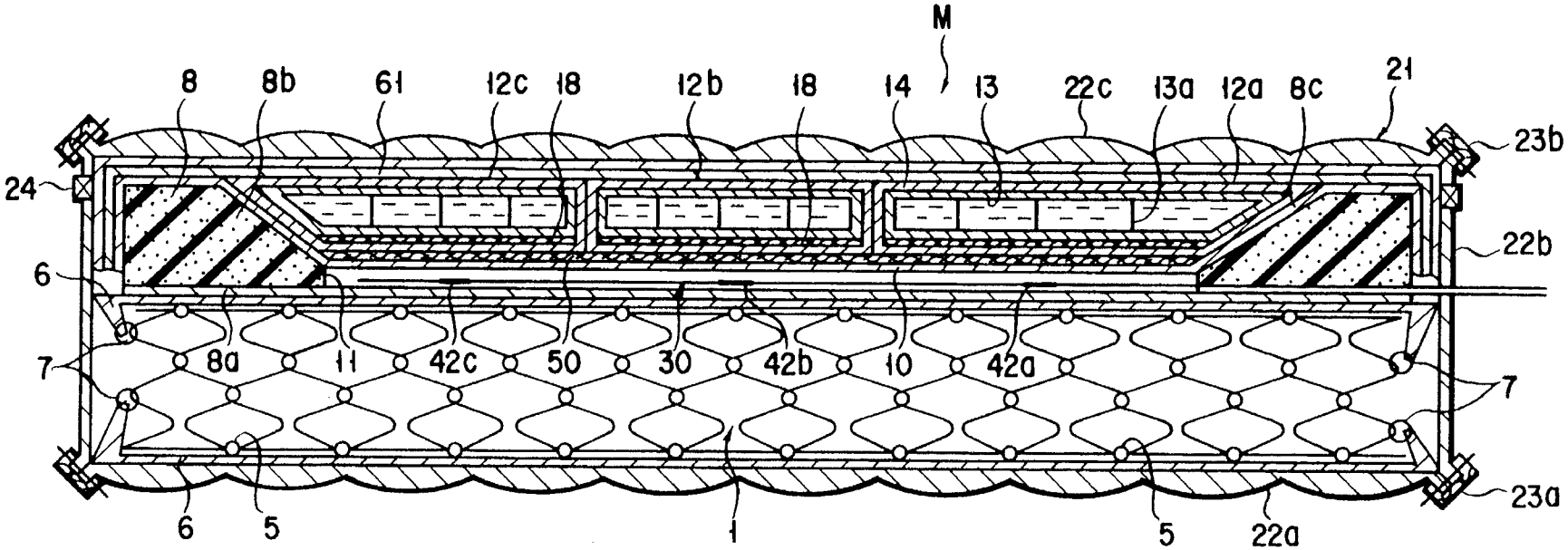
FIG. 1 is a vertical sectional view, showing the overall structure of a first embodiment of the invention.
Figure 2:
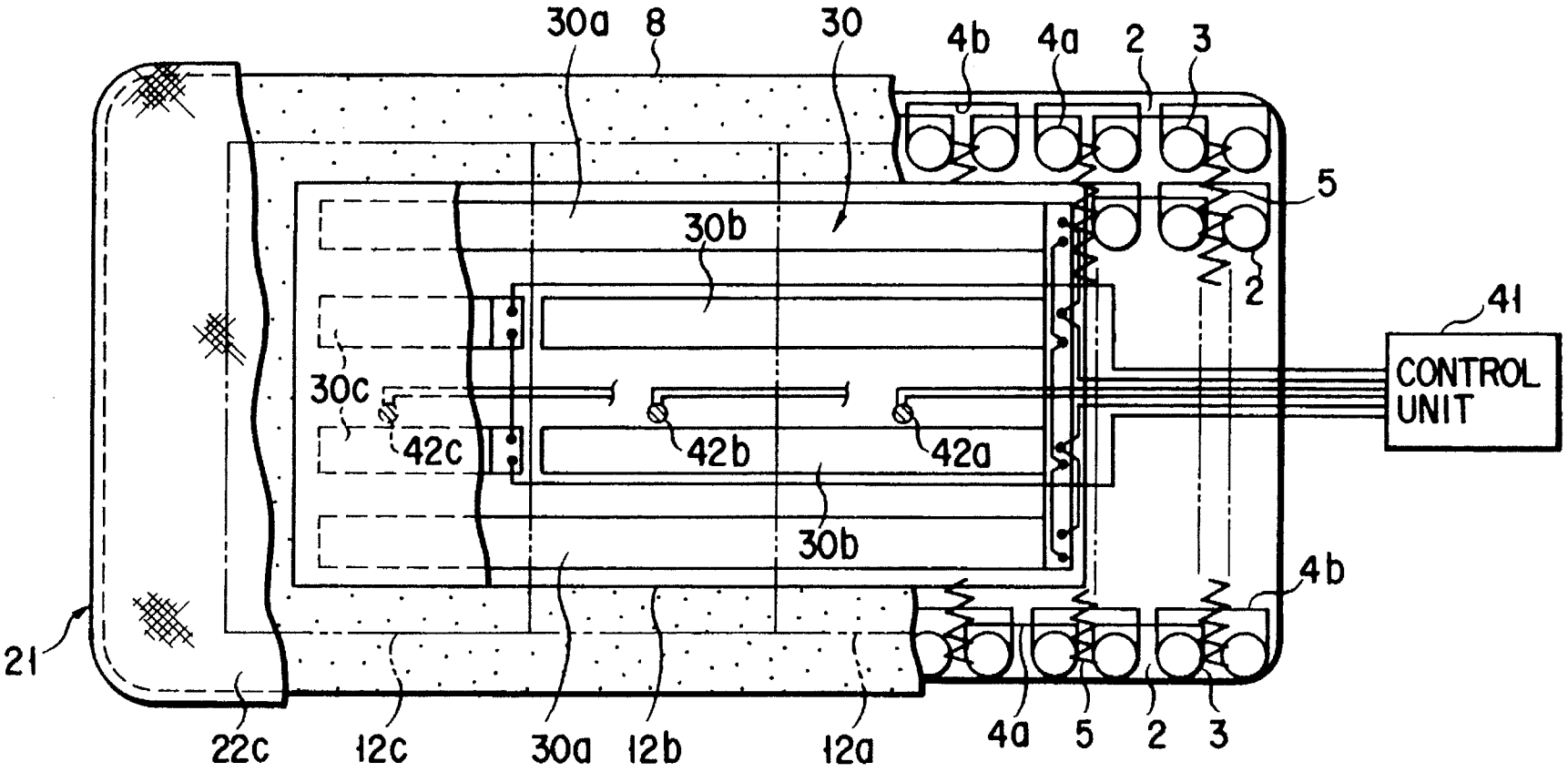
FIG. 2 is a partial horizontal sectional view, showing the first embodiment of the invention.

FIGS. 1–7 show a first embodiment of the invention. As is shown in FIG. 1, a watermattress apparatus M has a spring unit 1 as a cushion body shaped rectangular and having a predetermined thickness. As is shown in FIG. 2, the spring unit 1 comprises a plurality of continuous springs 2 located parallel to one another and extending in the width direction.

Figure 7:
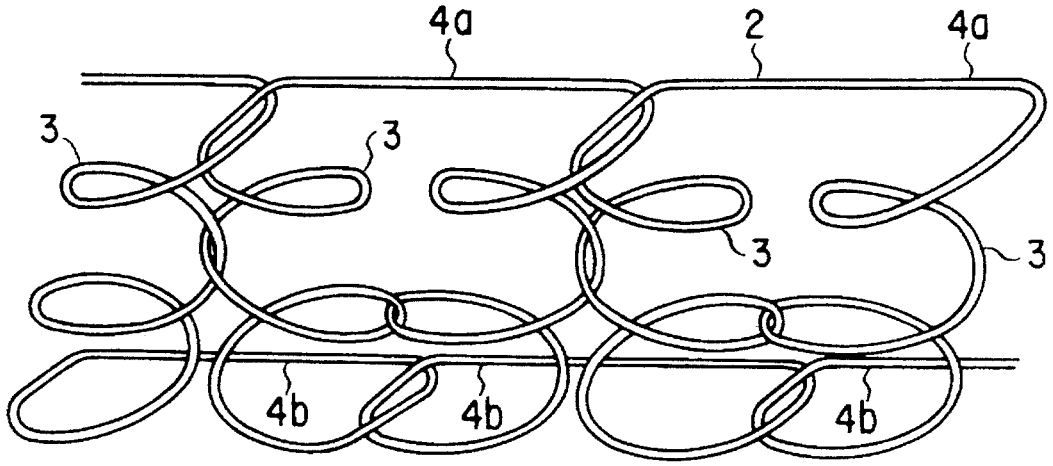
FIG. 7 is a perspective view, showing a continuous spring forming a spring unit employed in the first embodiment.

As is shown in FIG. 7, each continuous spring 2 consists of a single wire having a plurality of coil portions 3 arranged in line. The upper and lower ends of each adjacent pair of the coil portions 3 are connected by means of upper and lower linear coupling portions 4*a* and 4*b*, respectively. The upper and lower linear coupling portions 4*a* and 4*b* are arranged with different pitches in the longitudinal direction of the continuous spring 2. Each adjacent pair of the coil portions 3 have parts entangled with one another.

As is shown in FIG. 2, the continuous springs 2 arranged parallel to one another are coupled by means of helical wires 5. In other words, the helical wires 5 are wound on the upper and lower ends of the coil portions 3, i.e., on side portions of the upper and lower linear coupling portions 4*a* and 4*b*.

As is shown in FIG. 1, protection sheets 6 made of e.g. a felt are provided on the upper and lower surfaces of the spring unit 1. Peripheral portions of each protection sheet 6 are coupled with the spring unit 1 by means of clips 7.

Figure 4:
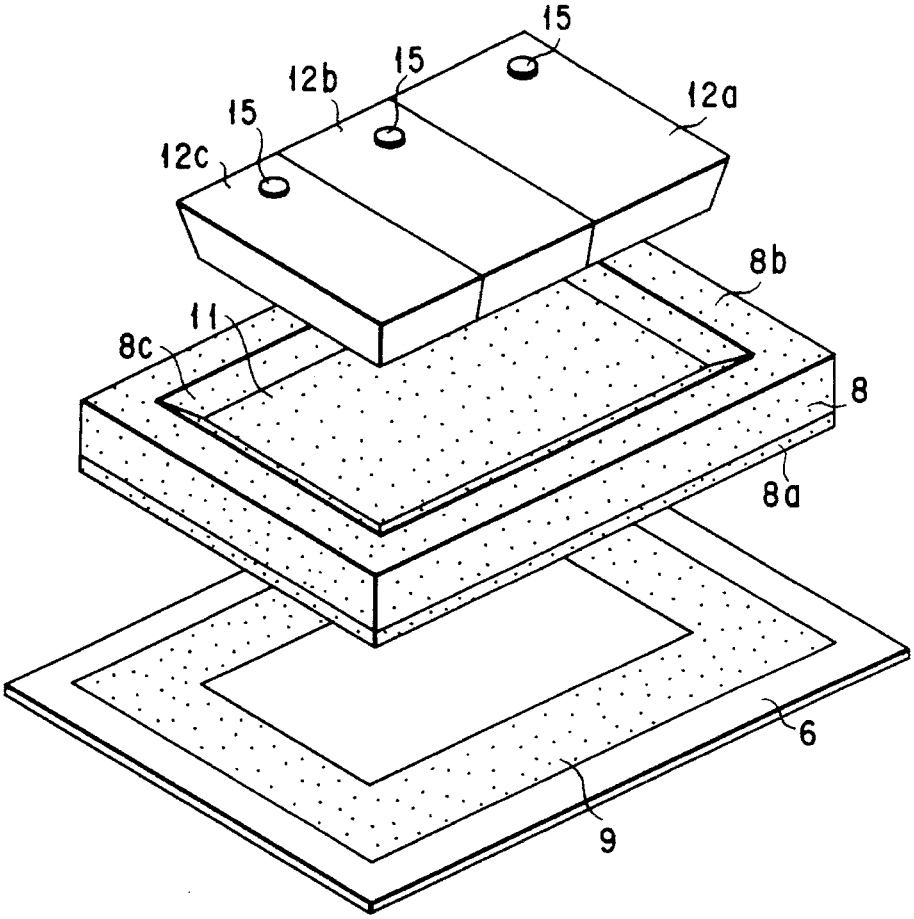
FIG. 4 is an exploded perspective view, showing a protection sheet, a case and a water bag employed in the first embodiment.

A case 8 is adhered to the upper protection sheet 6, with an adhesive layer 9 interposed therebetween, as is shown in FIG. 4. Thus, the case 8 is prevented from being displaced on the spring unit 1.

As is shown in FIG. 4, the case 8 comprises an air-permeable and elastic base plate 8*a* made of a semi-elastic material, such as a urethane foam mixed with a bacteria-proof agent and/or a mold-proof agent; and a frame body 8*b* made of a urethane foam having an elasticity identical to or little softer than the base plate 8*a*, and formed on a peripheral portion of the base plate 8*a*, integral as one body.

Accordingly, an upper receiving portion 11 is defined by the frame body 8*b* in the case 8. The frame body 8*b* has an inclined inner peripheral surface 8*c*.

A heater plate 30 as shown in FIG. 2 is provided on the bottom of the receiving portion 11. Further, as is shown in FIG. 1, a waterproof bottom sheet 10 made of a synthetic resin covers the upper surface of the heater plate 30, and the peripheral surface, the inclined surface and the upper surface of the case 8.

Figure 5:
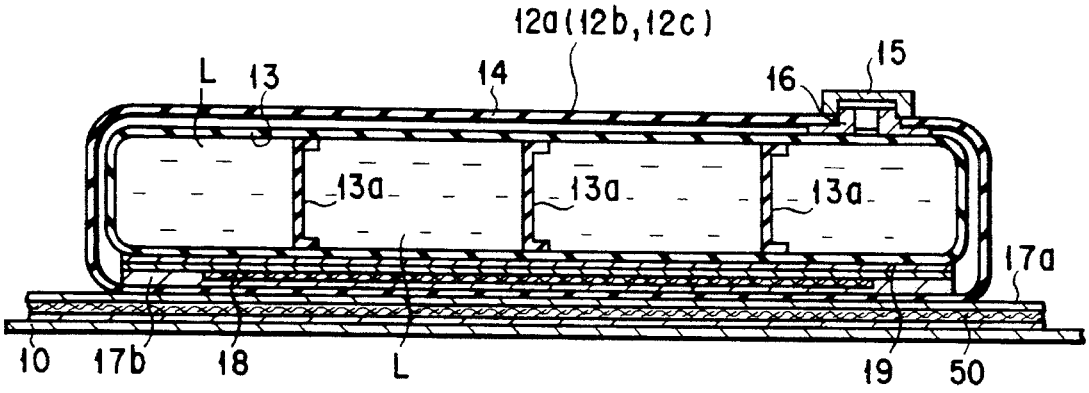
FIG. 5 is a sectional view, showing the water bag, and first and second inner liquid-absorbing sheets provided on the lower side of the water bag.

As is shown in FIGS. 1 and 5, a bag 17*a* containing a first inner absorbent 50 made of a liquid-absorbing material (hereinafter referred to) is provided on the upper surface of the bottom sheet 10 in the receiving portion 11. The bag 17*a* is made of a material, such as nonwoven fabric cloth, which can pass a liquid therethrough.

First through third flat water bags 12*a*–12*c* are provided on the first inner absorbent 50 parallel to one another in the longitudinal direction of the mattress apparatus M. As is shown in FIG. 5, each water bag has a double structure consisting of an inner bag 13 formed of a flexible waterproof sheet, and an outer bag 14 containing the bag 13.

A plug 16, which communicates with the interior of the inner bag 13 and can be closed with a cap 15, projects from the upper surface of the outer bag 14. Through the plug 16, water or a liquid L, such as a gel, can be supplied or discharged.

Figure 6:
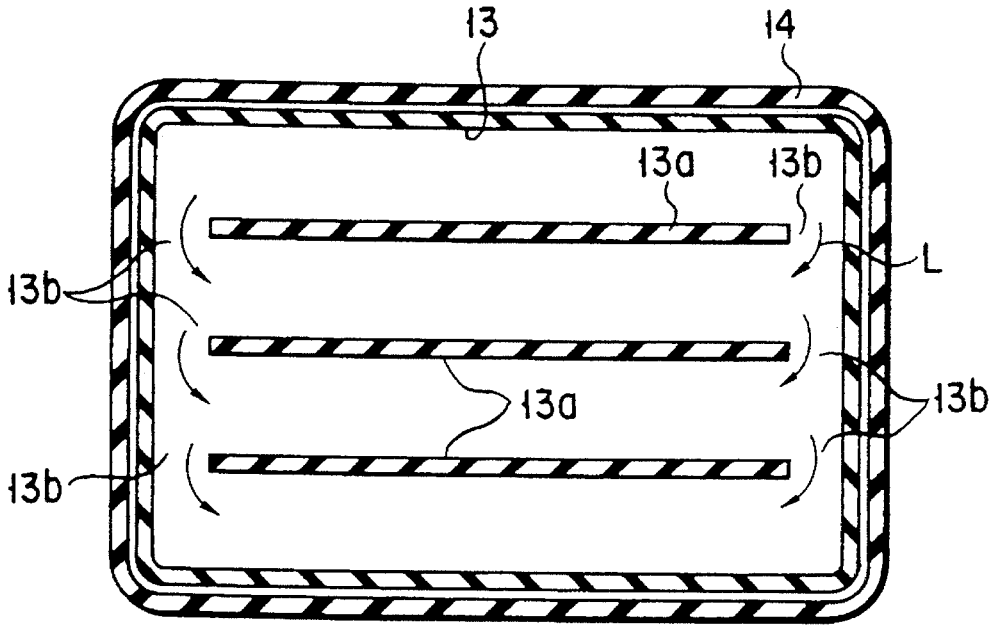
FIG. 6 is a transverse sectional view, showing the interior of the water bag.

As is shown in FIGS. 5 and 6, a plurality of partitioning band sheets 13*a* are provided in the inner bag 13 at regular intervals, with their upper and lower ends attached to the upper and lower inner surfaces of the inner bag 13. The length of each partitioning sheet 13*a* is shorter than the width of the water bag 12*a* (12*b*, 12*c*). As a result, liquid lines 13*b* for passing the liquid L are formed at opposite ends of the sheets 13*a* in the longitudinal direction thereof.

The partitioning sheets 13*a* enables the liquid L to flow uniformly in the water bag 12*a* (12*b*, 12*c*). Even if the water bag has its width-directional one side (i.e., the upper or lower side) excessively compressed, the partitioning sheets 13*a* prevents expansion of the other side of the bag.

Further, the water bag 12*b* located at the center of the three bags 12*a*–12*c* in the longitudinal direction for supporting the hip of the user has a hardness greater than the other two bags 12*a* and 12*c*.

To set the central water bag 12*a* harder, a liquid L of a high viscosity or of a high pressure is contained therein. Otherwise, a plurality of water bags with a length shorter than the water bag 12*b* may be arranged parallel to one another in place of a single water bag 12*b*.

As is shown in FIG. 5, a bag 17*b* formed of nonwoven fabric cloth and containing a second inner absorbent 18 is fixed by means of an adhesive double coated tape between the outer lower surface of the inner bag 13 and the inner lower surface of the outer bag 14. Each of the first and second inner absorbents 50 and 18 is formed of a powdered highly-absorbing resin such as powdered acrylic acid vinyl alcohol copolymer or acrylic acid soda copolymer, or of a nonwoven fabric sheet coated with such powder.

When the inner bag 13 of the water bag 12*a* (12*b*, 12*c*) has been broken or deteriorated, and the liquid L has leaked therefrom to the outer bag 14, the liquid L is absorbed in the second inner absorbent 18, thereby preventing the material from leaking out of the outer bag 14. Further, even when the outer bag 14 has also been broken, the liquid L leaks from the outer bag 14 to the receiving portion 11 and is absorbed in the first inner absorbent 50 provided on the bottom sheet 10.

Although the first and second inner absorbents 50 and 18 become solid lumps, these lumps are prevented from scattering since they are received in the nonwoven-fabric bags 17*a* and 17*b*, respectively.

The inner bag 13 is made of a semi-transparent material, and the outer bag 14 is made of a transparent material. Therefore, when the liquid L has leaked from the inner bag 13, the leakage can be seen from the outside.

Figure 3A:
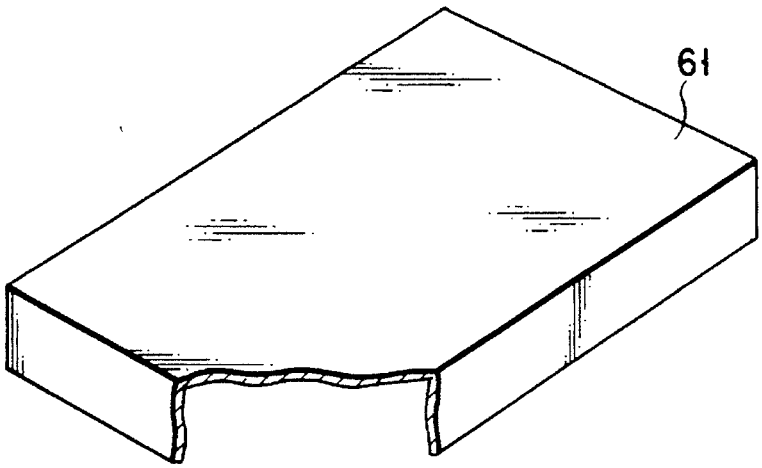
FIG. 3A is a perspective view, showing a top sheet employed in the first embodiment.

The upper surface of the case 8 is covered with a waterproof top sheet 61 made of vinyl, etc. As is shown in FIG. 3A, the top sheet 61 is shaped like a bottomless box.

Moreover, as is shown in FIG. 1, the top sheet 61 covers the upper opening of the receiving portion 11 and the outer periphery of the case 8. As is shown in FIG. 3C, a third inner absorbent 62*a* and an inner bacteria/mold proof sheet 63*a* formed of nonwoven fabric are adhered in this order to the inner surface of the top sheet 61, while a first outer absorbent 62*b* and a first outer bacteria/mold proof sheet 63*b* are adhered in this order to the outer surface of the top sheet 61.

Figure 3B:
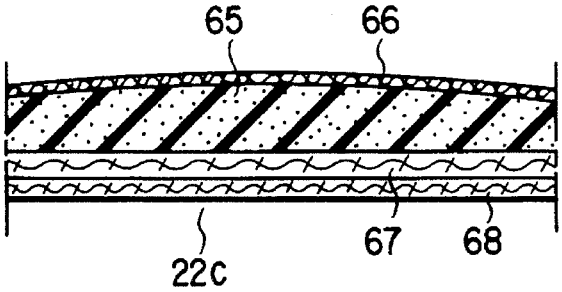
FIG. 3B is a partially enlarged sectional view, showing the upper cloth layer of an envelope employed in the first embodiment.
Figure 3C:
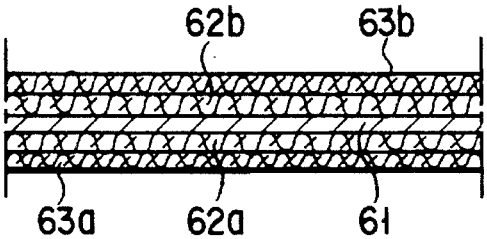
FIG. 3C is a partially enlarged sectional view, showing the top sheet.
Figure 3D:
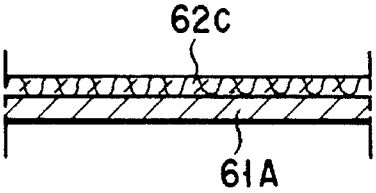
FIG. 3D is a partially enlarged sectional view, showing a modification of the top sheet.

As is shown in FIG. 3D, the top sheet 61 may be replaced with a top sheet 61A, which is made of a resin mixed with a bacteria/mold proof agent, and has an outer surface to which a nonwoven fabric cloth layer 62*c* coated with an absorbent is adhered.

The spring unit 1 and the case 8 are covered with an envelope 21. As is shown FIG. 1, the envelope 21 comprises a lower cloth layer 22*a* covering the lower surface of the spring unit 1, a peripheral cloth layer 22*b* covering the peripheral surface of the same, and an upper cloth layer 22*c* covering the upper surface of the same. The peripheral cloth layer 22*b* has its lower end attached to the periphery of the lower cloth layer 22*a* by stitching using a tape 23*a*, and its upper end attached to the periphery of the upper cloth layer 22*c* by stitching using a tape 23*b*.

A fastener 24 is provided along the overall length of the periphery of an upper portion of the peripheral cloth layer 22*b*, enabling the upper cloth layer 22*c* to be opened and closed. The water bag 12 in the case 8 can easily be inspected or exchanged with a new one by opening the upper cloth layer 22*c*.

As is shown in FIG. 3B, the upper cloth layer 22*c* has an elastic sheet 65 made of urethane foam and covered with cloth 66. A second outer absorbent sheet 67 and a second bacteria/mold proof sheet 68 are laminated in this order on the inner surface of the elastic sheet 65.

Further, the upper cloth layer 22*c* may have sweat-absorbing cotton, bacteria/mold proof urethane foam, nonwoven fabric cloth with an absorbent, and a bacteria/mold sheet laminated on the inner surface of the cloth 66 in this order.

Like the first and second inner absorbents 50 and 18, the third inner absorbent 62*a*, and the first and second outer absorbents 62*b* and 67 are formed of a powdered highly absorbing resin such as powdered acrylic acid vinyl alcohol copolymer or acrylic acid soda copolymer, or formed of a nonwoven fabric sheet coated with a powdered highly absorbing resin.

The third inner absorbent 62*a* provided on the inner surface of the top sheet 61 absorbs a liquid L leaking from the receiving portion 11 to the outside thereof. The first outer absorbent 62*b* provided on the outer surface of the top sheet 61, and the second outer absorbent 67 provided on the upper cloth layer 22*c* of the envelope 21 absorb moisture, such as the sweat of the user or moisture in the atmosphere, which has passed the upper cloth layer 22*c*, thereby preventing the moisture from condensing on the upper surface of the top sheet 61.

As is shown in FIG. 2, the sheet heater 30 comprises four lines of heater elements arranged in the width direction of the receiving portion 11. A pair of outer (first) sheet heater elements 30*a* have a length equal to the overall length of the receiving portion 11, i.e., corresponding to the sum of the lengths of the water bags 12*a*–12*c*. The other inner (second) sheet heater elements each consist of a second sheet heater element 30*b* with a length corresponding to the sum of the lengths of the first and second water bags 12*a* and 12*b*, and a third sheet heater element 30*c* equal to the length of the third water bag 12*c*.

Each of the heater elements 30*a*–30*c* is heated under the control of a control unit 41. Specifically, as is shown in FIG. 2, thermistors 42*a*–42*c* are provided in the receiving portion 11 for detecting the temperatures of the first through third water bags 12*a*–12*c*, respectively. Signals from the thermistors 42*a*–42*c* are supplied to the control unit 41, which in turn calculates the average value of the detected temperatures of the thermistors 42*a*–42*c*. The control unit 41 then heats the third sheet heater element 30*c* to a temperature 2°–3° C. higher than the average value.

The temperatures of the first and second sheet heater elements 30*a* and 30*b* can be set by a setting section (not shown) employed in the control unit 41. Accordingly, if the first and second sheet heater elements 30*a* and 30*b* are set to 33° C., the third sheet heater element 30*c* is controlled to 35°–36° C.

The first and second sheet heater elements 30*a* and 30*b* control the temperatures of the liquid L in the first and second water bags 12*a* and 12*b*, respectively, while the third sheet heater element 30*c* controls the temperature of the liquid L in the third water bag 12*c*. Since the water bags 12*a*–12*c* are separated from one another, they have a low thermal conductivity therebetween. Therefore, temperature control can be performed so that the liquid L in the third water bag 12*c* can have a temperature 2°–3° C. higher than the liquid L in the first and second water bags 12*a* and 12*b*.

Thus, the temperature of the third water bag 12*c* can be controlled to a value higher than that of the other water bags 12*a* and 12*b*. Accordingly, when the user lies on the watermattress apparatus M with his legs put on the water bag 12*c*, the legs are heated 2°–3° C. higher than the other portions of the body. Therefore, the user can have a good sleep.

The liquid L in the third water bag 12*c* can be heated not only by the third sheet heater element 30*c* but also by the first sheet heater element 30*a*. However, since the water bag 12*c* has a large heat capacity and is usually kept 2°–3° C. higher than the other water bags, the liquid L in the water bag 12*c* can be controlled to a predetermined temperature only by the third sheet heater element 30*c*.

In the above-described watermattress apparatus M, if the inner and outer bags 13 and 14 of one of the three water bags 12*a*–12*c* has been broken and the liquid L has leaked therefrom, while the user lies on the upper cloth layer 22*c*, the liquid L is absorbed in the first inner absorbent 50 provided between the inner and outer bags 13 and 14.

Further, if the liquid L has leaked from the outer bag 14 without being absorbed by the first inner absorbent 50, it is absorbed by the second absorbent 18 provided on the bottom sheet 10 in the receiving portion 11. Thus, even when it has leaked from the water bags 12*a*–12*c*, there is almost no possibility of the liquid L leaking to the outside of the receiving portion 11.

If a great amount of liquid L has leaked from the water bags 12*a*–12*c* at a time, or if the user continues to lie on the apparatus where the liquid L has been leaked therefrom, the force of the liquid L which causes itself to leak from the receiving portion 11 to the outside thereof is large. In this case, however, the liquid L is absorbed in the third inner absorbent 62*a* provided on the inner surface of the top sheet 61, which is located on the upper surface of the receiving portion 11. Thus, the liquid L can be prevented from leaking from the receiving portion 11 to the outside thereof.

Moreover, the sweat of the user lying on the mattress apparatus M or moisture in the atmosphere permeates the upper cloth layer 22*c* of the envelope 21. Moisture which has permeated the upper cloth layer 22*c* is absorbed in the second outer absorbent 67 provided on the lower surface thereof, and moisture which has not been absorbed therein is absorbed in the first outer absorbent 62*b* on the upper surface of the top sheet 61.

The moisture absorbed in the second and first outer absorbents 67 and 62*b* is kept therein. Therefore, the sweat of the user and/or moisture in the atmosphere, which have permeated the upper cloth layer 22*c*, are prevented from condensing on the upper surface of the top sheet 61 and again being absorbed in the upper cloth layer 22*c*, or prevented from being kept in the upper cloth layer 22*c*. Thus, the upper cloth layer 22*c* is free from a moist state, and the top sheet 61 is free from dew condensation thereon. As a result, the mattress apparatus can be used comfortably.

Since the moisture once absorbed in the absorbents does not flow back, the upper cloth layer 22*c* is further free from a moist state, and the top sheet 61 is further free from dew condensation.

The bacteria/mold proof sheets 63*a*, 63*b* and 68 provided on the inner and outer surfaces of the top sheet 61 and the inner surface of the upper cloth layer 22*c* can prevent propagation of bacteria and/or mold on the inner and outer surfaces of the top sheet 61 or in the upper cloth layer 22*c*, thereby keeping the watermattress apparatus M in a sanitary state.

The spring unit 1 comprises a plurality of continuous springs 2 arranged in parallel. Since each continuous spring 2 has coil portions 3 formed continuous, it is hard to deform part of the spring 2, i.e., hard to deform a particular coil portion 3. Actually, when a load has been exerted on the spring 2, many of the coil portions 3 are elastically deformed at a time. This means that the spring 2 is smoothly deformed. Accordingly, each of the water bags 12*a*–12*c* placed on the spring unit 1 is prevented from being partially greatly deformed due to a load exerted thereon, with the result that the performance of the watermattress apparatus can be kept at high level.

Figure 8:
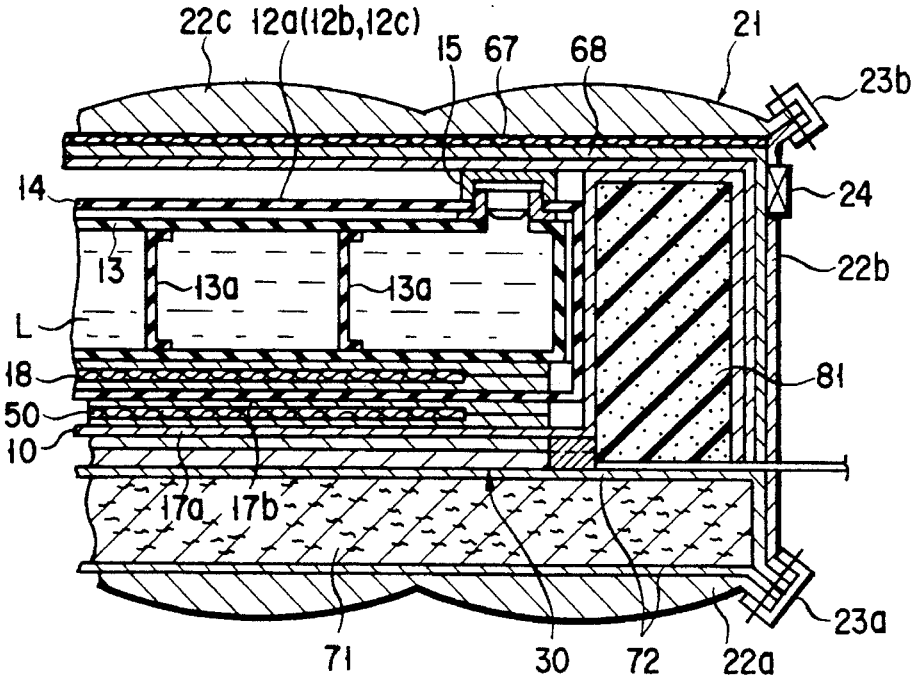
FIG. 8 is a partial sectional view of a watermattress apparatus according to a second embodiment of the invention.

FIG. 8 shows a second embodiment of the invention, in which elements similar to those employed in the first embodiment are denoted by corresponding reference numerals, and no detailed explanation is given thereof. In the second embodiment, an elastic plate 71 made of e.g. urethane foam and having a predetermined thickness is used as a cushion body in place of the spring unit 1. The elastic plate 71 may be further formed of an air-permeable fiber cushion e.g. of polyester fiber coated with a bacteria/mold proof agent.

The upper and lower surfaces of the elastic plate 71 is covered with a nonwoven-fiber sheet 72 to protect the plate 71 from damage due to friction. A peripheral portion of the sheet 72 is sutured with peripheral portions of the peripheral cloth layer 22*b* and lower cloth layer 22*a* of the envelope 21 by the use of the tape 23*a*, thereby preventing the plate 71 from moving relative to a case 81.

The case 81 is shaped rectangular and made of an elastic material such as urethane foam. The case 81 has such a hardness as enables itself to be little deformed by a force exerted on the inner peripheral surface thereof when the water bags 12*a*–12*c* received therein are deformed. The bottom sheet 10 covers the upper surface and the outer and inner peripheral surfaces of the case 81.

Figure 9:
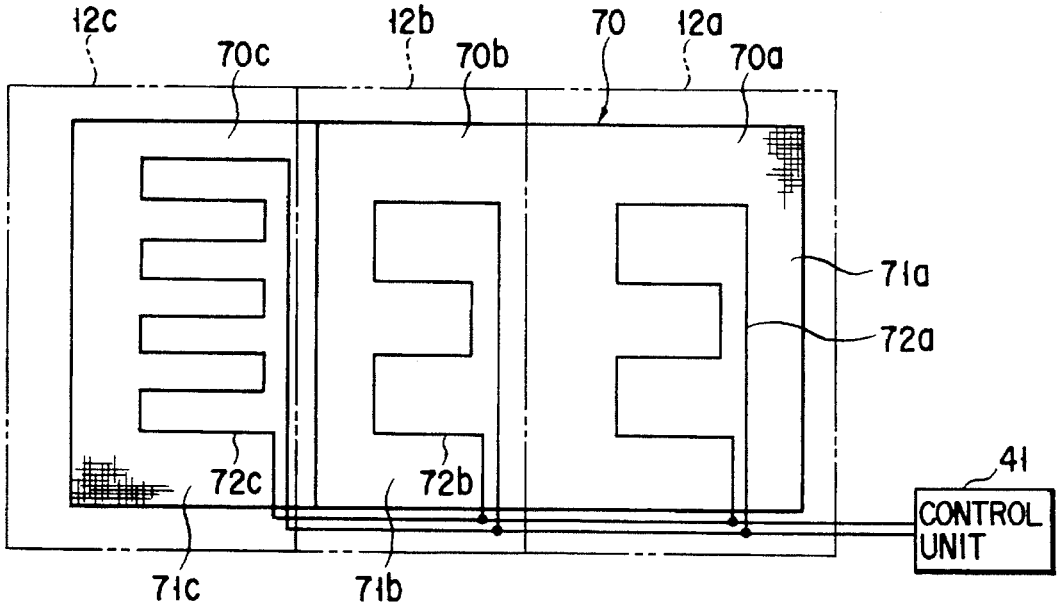
FIG. 9 is a schematic view, showing control means for controlling the temperature of a liquid contained in the water bag, according to a third embodiment of the invention.

FIG. 9 shows a third embodiment of the invention. This embodiment is characterized by a sheet heater 70. The sheet heater 70 is divided into first through third sheet heater elements 70*a*–70*c* corresponding to the water bags 12*a*–12*c*, respectively. The sheet heater element 70*a* (70*b*, 70*c*) consists of a sheet 71*a* (71*b*, 71*c*) and a heating wire 72*a* (72*b*, 72*c*) embedded in the sheet 71*a* (71*b*, 71*c*). The heating wire 72*c* of the third sheet heater element 70*c* is longer than the other heating wires. In other words, the sheet heater element 70*c* has a heating value higher than the other sheet heater elements.

Accordingly, when the sheet heater elements 70*a*–70*c* have been connected to a power source under the control of the control unit 41, the third sheet heater element 70*c* with the long heating wire 72*c* generates heat of a higher temperature than the other sheet heater elements 70*a* and 70*b*. Therefore, appropriately setting the length of the heating wire 72*c* of the third sheet heater element 70*c* enables the liquid L in the third water bag 12*c* to be heated 2°–3° C.

higher than the liquid L in the first and second water bags 12*a* and 12*b*, as in the first embodiment.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A watermattress apparatus comprising:

a cushion body being elastically compressed when a load has been exerted thereon;

a case having an upper and a lower surface and a receiving portion opening to the upper surface, the lower surface being provided on an upper surface of the cushion body;

a water bag formed of a flexible waterproof sheet, containing a liquid therein, and received in the receiving portion of the case;

the water bag having a double structure including an inner bag containing the liquid, and an outer bag receiving the inner bag, and further comprising absorbing means provided between the inner and outer bags for absorbing liquid that leaks from the inner bag; and an envelope covering the cushion body and case.

2. The watermattress apparatus according to claim 1, wherein the lower surface of the case is adhered to the upper surface of the cushion body.

3. The watermattress apparatus according to claim 1, wherein the inner bag has a partitioning band sheet having upper and lower ends secured to upper and lower inner surfaces of the inner bag, respectively.

4. The watermattress apparatus according to claim 1, wherein the outer bag comprises a transparent material.

5. The watermattress apparatus according to claim 1, wherein the case comprises an elastic material which is elastically compressed when a load has been exerted thereon.

6. The watermattress apparatus according to claim 1, wherein the cushion body has a plurality of continuous springs arranged parallel to one another, each of the continuous springs having a plurality of continuous coil portions formed of a single wire and arranged in line.

7. The watermattress apparatus according to claim 1, wherein the water bag has a plurality of water bag elements arranged parallel to one another in a longitudinal direction of the case.

8. The watermattress apparatus according to claim 7, wherein a middle one of the plurality of water bag elements arranged parallel to one another is set to be harder than other ones of the plurality of water bag elements.

9. A watermattress apparatus comprising:

a case having upper and lower surfaces and a receiving portion opening to the upper surface;

a water bag formed of a flexible waterproof sheet, containing a liquid therein, and received in the receiving portion;

inner absorbent means provided in the receiving portion for absorbing a liquid which has leaked from the water bag to the receiving portion;

a waterproof sheet covering the upper side of the case for preventing the liquid from leaking from the receiving portion to an outside thereof; and an envelope covering the case.

10. The watermattress apparatus according to claim 9, wherein the water bag has a double structure comprising inner and outer bags, and the inner absorbent means comprises a first inner absorbent provided on an inner bottom surface of the receiving portion, and a second inner absorbent provided between the inner and outer bags of the water bag.

11. The watermattress apparatus according to claim 10, wherein the outer bag comprises a transparent material.

12. The watermattress apparatus according to claim 9, wherein an outer absorbent means is provided on an upper side of the water bag for absorbing moisture which has permeated the envelope from an outside thereof.

13. The watermattress apparatus according to claim 12, wherein the outer absorbent means comprises at least one of a first outer absorbent provided on an outer surface of the waterproof sheet and a second outer absorbent provided on an inner surface of the envelope.

14. The watermattress apparatus according to claim 9, wherein the case is laminated on an upper surface of a cushion body which is elastically compressed when a load is exerted thereon.

15. The watermattress apparatus according to claim 9, wherein the case comprises an elastic material which is elastically compressed when a load is exerted thereon.

* * * * *